US005848706A

United States Patent [19]

Harris

[11] Patent Number: 5,848,706

[45] **Date of Patent: *Dec. 15, 1998**

[54] SORTING APPARATUS

[75] Inventor: Robert John Harris, Essex, United Kingdom

[73] Assignee: Sortex Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 627,219

[22] Filed: Mar. 19, 1996

[51] Int. Cl.[6] ..... B07C 5/342

[52] U.S. Cl. ..... 209/580; 209/587; 209/639

[58] Field of Search ..... 209/580, 581, 209/582, 587, 639, 638, 642, 577, 576; 15/302, 304, 320, 300.1, 339, 406, 316.1, 318, 312.1

[56] References Cited

U.S. PATENT DOCUMENTS

| | | | |
|---|---|---|---|
| 4,699,274 | 10/1987 | Saika | 209/580 X |
| 4,799,596 | 1/1989 | Mallant | 209/580 |
| 5,197,159 | 3/1993 | Truong | 15/304 |
| 5,271,505 | 12/1993 | Low | 209/587 |
| 5,631,460 | 5/1997 | Gray et al. | 209/580 X |

FOREIGN PATENT DOCUMENTS

0682990A1 11/1995 European Pat. Off. .

*Primary Examiner*—David H. Bollinger
*Attorney, Agent, or Firm*—Christie, Parker & Hale, LLP

[57] ABSTRACT

In an apparatus for sorting material into desired and undesired pieces or portions according to their optical characteristics, comprising a background, and a viewing means for viewing the material against the background; a method for removing debris from the background is proposed which comprises providing a jet of air or water which is moved relative to and across the background, and directed towards the background so as to remove debris and thereby clean the background. The jet is positioned out of the field of view of the viewing means so that debris removal can take place without interruption of the sorting process. A magnetic type air-cylinder, in which exhaust gas is fed back as the debris-removing air-jet, is preferably used.

21 Claims, 4 Drawing Sheets

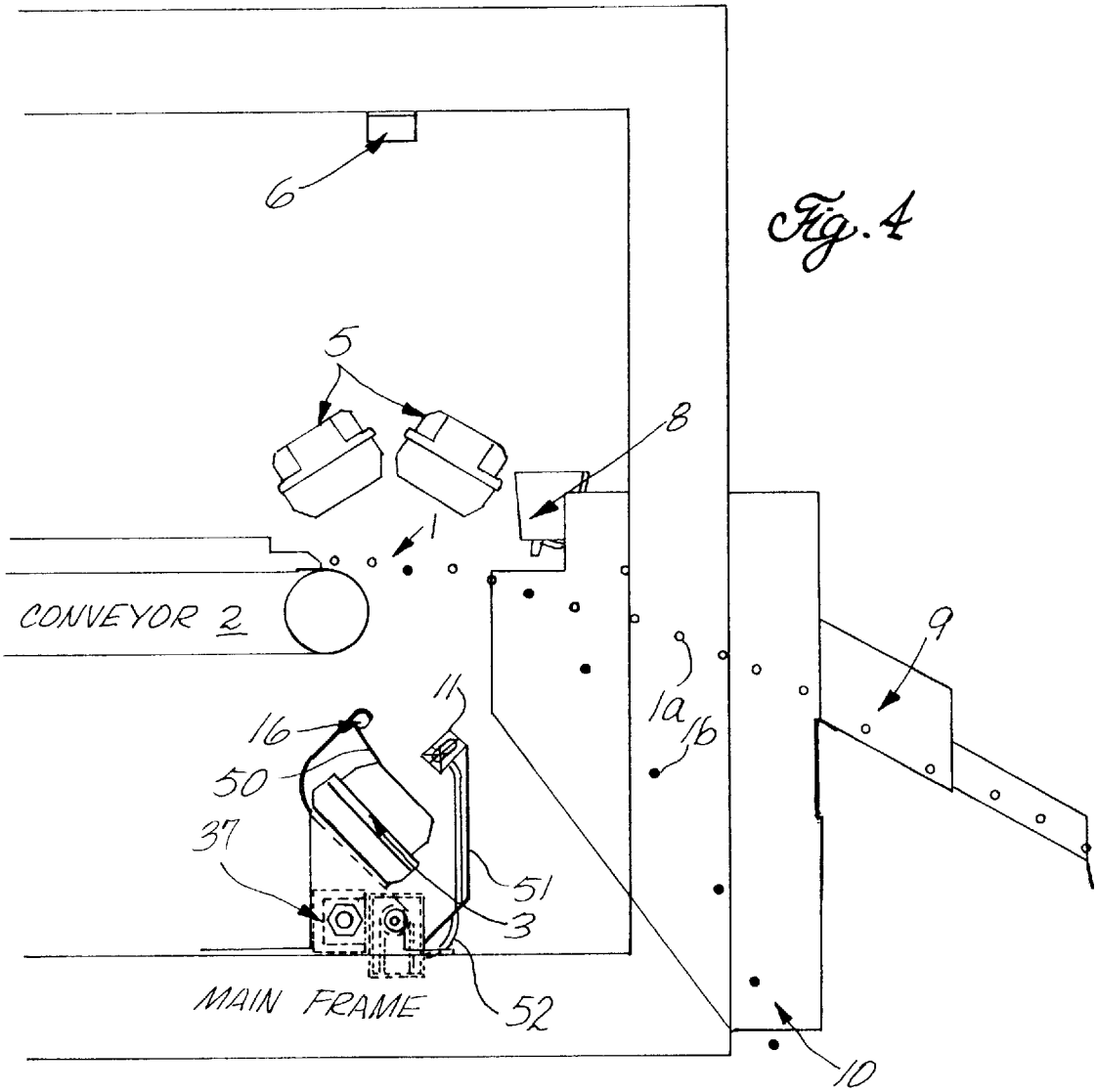
Fig. 4
Fig. 9
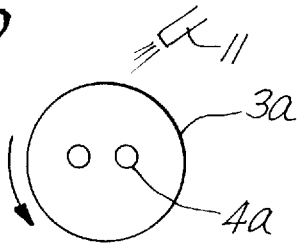

SORTING APPARATUS

BACKGROUND TO THE INVENTION

This invention relates to sorting apparatus. In particular, it relates to apparatus for sorting objects by their colour and/or shape and for effecting relative separation between desired and undesired objects according to their colour.

In particular, but not exclusively, the invention relates to apparatus for sorting organic matter such as vegetables or fruit.

It is known to sort small items such as fruit or vegetables by passing a stream of such articles across a viewing system where each article in turn may be viewed against a desired background. The background is preferably set to have a predetermined colour which is usually equivalent to the average colour of the articles being inspected, and any objects which deviate from a predetermined colour are caused to be rejected from the stream by an ejection means. Alternatively, an illuminated background may also be used to indicate the presence or absence of an object, and this background needs to be kept clean for reliability.

The ejection means generally uses jets of pressurised air although mechanical means such as paddles, etc, are used. The objects to be sorted may be directed into a stream by the use of chutes or conveyors.

The background against which the objects are viewed is generally illuminated and the precise optical characteristics of the background are often variable. Often, the background is set so that desired objects present the same degree of reflectivity, colour, luminance, or other optical parameter to a viewing sensor as the background. In this case, once the optical sensor detects a difference it assumes that an undesired object is present. It is clearly important that the optical characteristics of the background remain constant or at least remain bright enough.

Systems of this type work very well with relatively hard objects such as rice, beans or peas for example. However, when the systems are used with relatively soft matter, in particular with fruit or vegetables, the problem arises that these objects tend to pulp or release liquid when manipulated or ejected. The released pulp, puree or other liquid may tend to find its way under some circumstances, to either the light source which illuminates the articles for viewing or, more commonly, to the background. Clearly, any matter, including particles of produce, waste and water droplets on the background will tend to alter its optical characteristics and thus an optical sensor will incorrectly record optical characteristics or even the presence or absence of an object when the opposite is true.

Various means have been proposed in the past to overcome these problems. Wiping arrangements have been used which periodically wipe a light or a background but the wiper is intrusive. That is, by crossing the field of view of the optical sensors it may cause an incorrect reading to be made when the wiper is operative. Alternatively, the apparatus may be periodically stopped in order for cleaning to take place, but this is inconvenient, takes time and reduces product throughput. Other previously proposed methods have included the use of a rotating background or of projecting an image of a background onto a rotating body, the body itself being viewed and being cleaned whilst being rotated. This approach can be mechanically complex and also requires careful positioning of shielding arrangements which can themselves become contaminated or obscured by debris.

It is an object of the present invention to provide an improved method and apparatus for cleaning debris off a background or a light.

It is a further object to provide a method and apparatus in which the cleaning process may be continuous or periodic and non-intrusive such that the sorting process does not need to be periodically stopped in order for cleaning to occur.

SUMMARY OF THE INVENTION

According to the present invention there is provided apparatus for sorting material into desired and undesired pieces or portions according to their optical characteristics, comprising a background, a viewing means for viewing the material against the background and means for removing debris from the background, wherein said debris-removing means comprises means for providing a jet of fluid movable relative to the background, and directed towards the background, so as to clean the background.

The debris-removing means preferably is located to remain out of the optical path between the viewing means and the background.

The moving jet of fluid may be of air or other gas, or of a liquid such as water, or a combination of these.

In some embodiments means may be provided to provide a continuous flow of a liquid such as water over a background, from a source which is static with respect to the background and to further provide a mobile jet of air or other gas which periodically moves over the water flow.

The background may comprise a cover glass or a sleeve mounted over one or more light sources.

The sleeve may be rotating, either continuously or periodically, to further improve debris removal.

Where the fluid is air, it may be provided by an air cylinder of the type which uses air both to move a jet and also to provide the jet itself. The air cylinder may be a magnetic type air cylinder.

BRIEF DESCRIPTION OF THE DRAWINGS

Embodiments of the invention will now be described, by way of example only, with reference to the accompanying drawings, in which:

FIG. 4 shows a side view of a presently preferred embodiment of the present invention;

FIG. 9 shows an alternative background.

DETAILED DESCRIPTION OF EMBODIMENTS OF THE INVENTION

Figure 1:
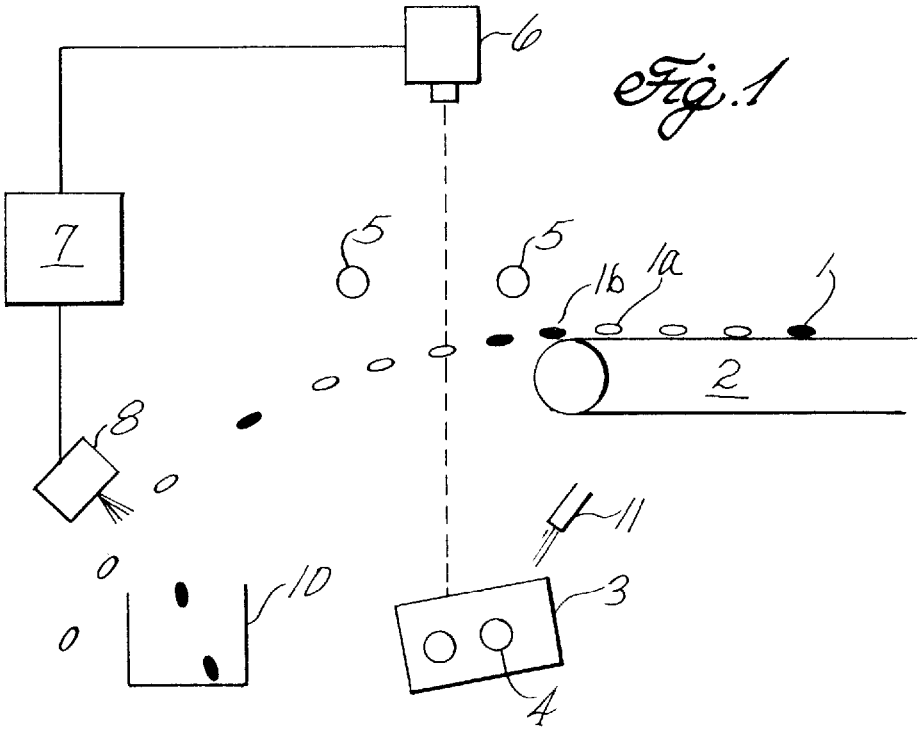
FIG. 1 shows schematically parts of a sorting apparatus.

Referring to FIG. 1, an apparatus is shown which is adapted for sorting objects, such as diced carrots for example. Many other types of objects may be sorted by this type of apparatus. These objects may be organic or non-organic ones.

A stream of objects 1 is imparted onto a conveyor. The objects comprise desired ones 1*a* and undesired ones 1*b*. In the case of diced carrots for example, the desired objects may be pieces of a specific orange colour, whereas the undesired pieces may be of a darker shade of colour, or green for example. The objects are imparted onto the conveyor in such a way that by the time they reach the end of the conveyor, they are travelling at the same speed and direction as the conveyor 2. The conveyor travels sufficiently fast so that at the end of the conveyor the objects 1 are sent forward in a stream under the effects of their momentum and gravity. While in the air, the objects are viewed against a background 3. The background is illuminated from within by one or more lamps 4 which are chosen to emit light of a specific frequency so as to give the background a specific colour. This colour may be varied by feedback means (not shown) to keep it constant or to vary it for use with different types of products.

The products are illuminated by one or more light sources 5 from above and a viewing system 6 views the stream of objects. At any time, the system views either an object or the background. If the background is set to be the same colour as desired objects, then it will not register any change between the background and a desired object. However, when an undesired object passes, the viewing system detects a different colour. The viewing system may include a scanning type camera, or any other type of camera, or optical sensor or sensor array, such as a photocell, photomultiplier, CCT, laser or other electro-optical means. The output from the viewing means is connected to a processing unit 7 which detects when an undesired object passes and actuates an ejector 8 at an appropriate time to eject that particular undesired object. Normally, the ejector has to be actuated a certain time after an undesired object is detected at viewing means 6, which time is sufficient for the object to move from the viewing position to the ejection position. The ejector preferably comprises an air jet but may comprise mechanical means. Desired objects pass unaffected by the ejector into a chute 9 and the undesired objects are ejected into a reject receptacle 10.

As stated above, problems can occur if the background is allowed to become contaminated by debris or is not cleaned regularly. This affects the colour of the background and therefore affects the accuracy of the sorting apparatus. According to the invention, there is proposed a cleaning or debris removing means 11 which, in its simplest aspect, provides a jet of fluid 12, such as water or other liquid, or air or other gas, onto the viewed face of the background 3. The jet is moved laterally with respect to the background and will normally be operated periodically. Thus, it may be operated once per minute so that when operated it moves swiftly from one end of the background to another, say in a second or so, and the jet, which is a relatively powerful one, of liquid or gas is applied during this time to the background to clean the background surface and remove debris therefrom. The viewed face of the background is therefore preferably sloped from the horizontal as shown schematically in FIG. 1 and the jet applied at the topmost part of this face such that the fluid flows down the face to carry away dirt and debris from the face.

The jet is positioned out of the field of view of the viewing means, that is, out of the optical path between the viewing means and background so that it can be used whilst sorting is taking place, without interruption thereof. The actual air or water jet does not substantially affect the colour characteristics of the background.

The movement of jet 11 is therefore into and out of the plane of the paper in the Figure.

The jet may be continually displaced back and forth but, preferably, it is only displaced periodically, say once per minute. When the jet is actuated, the flow of gas or liquid over the viewed face does not substantially affect the viewed colour properties of the face and therefore the sorting operation can continue whilst cleaning is taking place. This is a significant improvement over prior art systems in which, generally, the sorting operation had to be suspended each time a cleaning operation was performed and then restarted.

Figure 2:
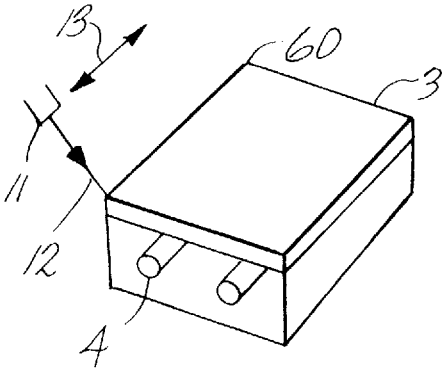
FIG. 2 shows an illuminated background having a cleaning means.

FIG. 2 shows a schematic perspective view of a background 3 illustrating two lamps 4 within the background. It should be noted that instead of lamps mounted underneath or within a background, the background may be illuminated from an external source. The jet 11 is supplied from a source of water, other liquid, air or other gas at a suitable pressure and is directed towards the topmost edge 60 of the background. It may alternatively be directed at other positions on the background. The jet moves across the face of the background laterally as shown by arrow 13, generally in a periodic manner.

Figure 3:
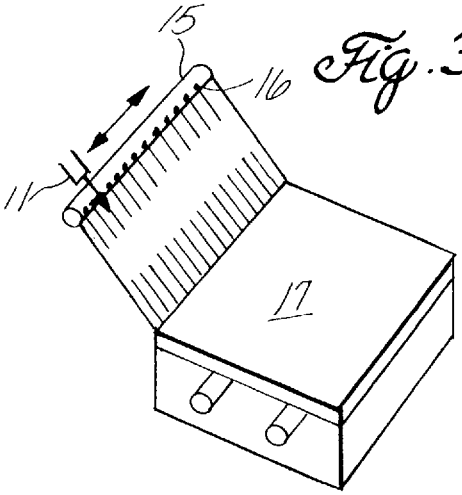
FIG. 3 shows an alternative arrangement of a cleaning means for an illuminated background.

FIG. 3 shows an alternative embodiment in which a constant stream of liquid, such as water, is applied to the background from a plurality of nozzles formed on a dispensing tube or other means 15. The tube is elongate and extends generally over the width of the background 3. The tube is provided with a plurality of nozzles 16 of suitable size and shape such that water which is emitted from the nozzles, by the time it reaches the face 17 of the background 3, forms substantially a continuous stream of water which flows over the background. This water source is therefore constant and applied over the entire background. The flowing water does not significantly affect the colour characteristics of the background. A further nozzle 11 is supplied with a source of gas such as air, and is mounted just above the water tube 15 and is moved laterally across it periodically, similarly to the jet of FIG. 2.

The system of FIG. 3 therefore continuously washes the background 3 with a stream of water which removes most debris. A jet of air is then periodically applied across the water to provide further cleaning and to remove embedded debris which the water may not have shifted.

The background may be cylindrical (eg. with its axis parallel to the direction of movement of the jet) or otherwise shaped and may be rotated, to further aid cleaning. It may comprise a sleeve 3*a* covering one or more lamps 4*a* as shown in FIG. 9. Alternatively, the background may be one which is rotated and illuminated indirectly, as shown in EP-A-0682990, which is incorporated herein by reference.

Figure 5:
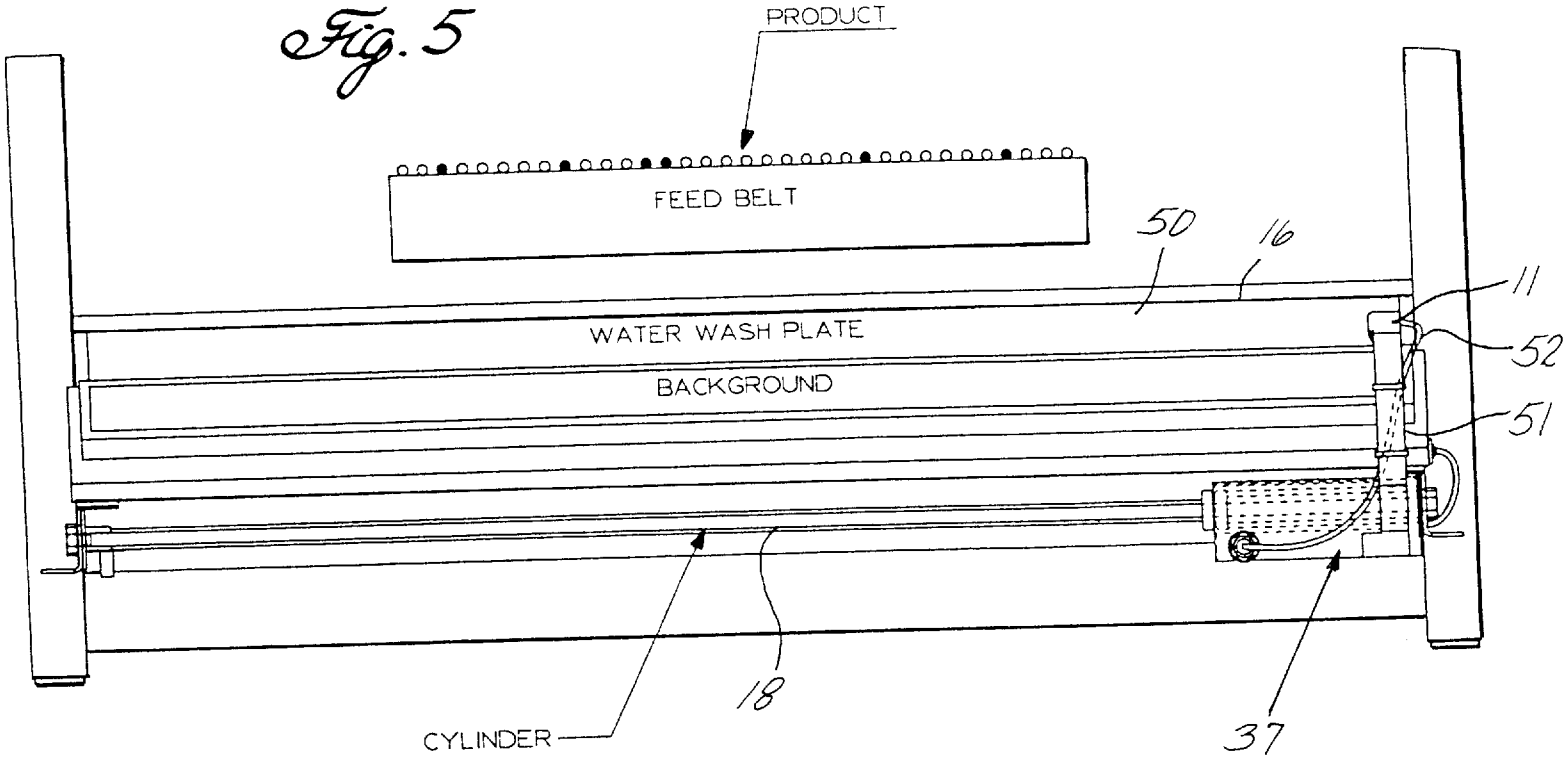
FIG. 5 shows a partial front view of the embodiment of FIG. 4.

FIGS. 4 and 5 show a presently preferred embodiment, in which the same reference numerals have been used to identify features shown in other drawings. The lamps and collection mechanisms have been omitted from FIG. 5.

A continuous water wash is applied across the background from a water supply tube 16, directed via a plate 50, onto background 3. An air jet is supplied from a movable nozzle 11, positioned as shown to direct its jet onto the background yet remaining out of the field of view of a camera 6. The field of view is restricted by the placing of lamps 5 in this example. The nozzle 11 is attached to an air-operated or other type of cylinder 18 which is actuated periodically to displace a piston 37 from one end to the other. Air nozzle 11 is linked to piston 37 to be moved therewith and accordingly to move across the face of the background. The nozzle may be connected to the piston by a bracket 51 for example and receive an air supply from a flexible hose 52. This may receive air from the same or a separate supply to the air cylinder or may use exhaust gas as described below.

Figure 6:
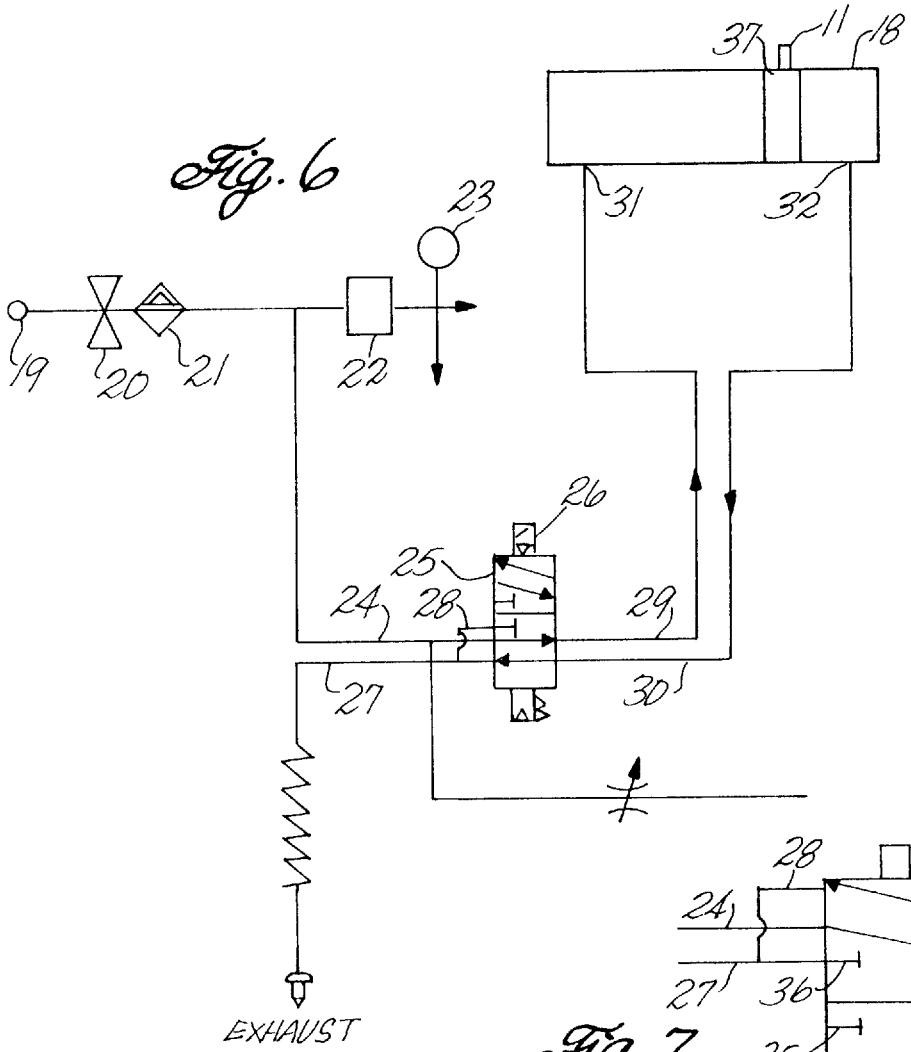
FIG. 6 shows a pneumatic apparatus for driving the cleaning means.

FIG. 6 shows part of an air supply system for a sorting apparatus and shows the air cylinder 18 which may be used to drive nozzle 11 across a background to provide fluid to that background.

Air from an inlet 19 is fed through an on/off valve 20 and a filter 21. The air supply line is branched and part of the supply is applied through a pressure regulating valve 22, past a pressure gauge 23 and onwards to other parts of the air-supply system not forming part of the present invention, such as an ejector mechanism. Part of the supply is supplied through a hose 24 to a multi-port valve 25, shown enlarged in FIG. 7. The multi-port valve 25 is movable between two positions by a solenoid 26.

Hose 24 is applied as an input to valve 25 in the Figure and hose 27 is applied as an output hose from this side. An additional hose link 28 joins hose 27 to a further port on the left-hand side. Two further hoses 29, 30 connect to the right side of the valve 25. These are connected at their respective distal ends to respective opposed inputs/outputs 31, 32 on air cylinder 18.

The term 'hose' is used here for convenience and may comprise a flexible or a rigid hose, conduit or line.

Valve 25 has four through-passages 31, 32, 33, 34. Two blanked passages 35, 36 are also provided, which open to the left of the valve but do not pass through to the right. Passages 31 and 32 extend perpendicularly to the direction of displacement of the valve by the solenoid, whereon passages 33 and 34 extend obliquely downwards from left to right.

In a first position of FIG. 6, hose 24 is adjacent passage 24 and air is thereby supplied through to hose 29, through cylinder 18 where it pushes a piston 37 to the right, and back, via hose 30, to exit hose 27. Hose 28 links to blanked passage 35. A separate air- or water-jet system is linked to piston 37 so that the jet is displaced as piston 37 moves.

Figure 7:
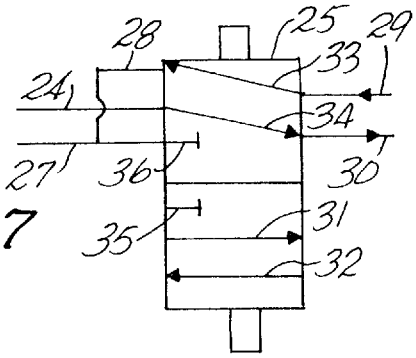
FIG. 7 shows an enlarged view of a multi-port valve.

After energising the solenoid, the valve drops to the position shown in FIG. 7. Hose 24 is then adjacent passage 34 which passes air to hose 30. The passage therefore acts as a cross-over. Air then flows through cylinder 18 in the opposite direction to that of FIG. 6 and the cylinder is displaced from right to left. Return air through hose 29 passes through passage 33 to hose 28, and hence through to exit hose 27.

Preferably, the cylinder is displaced periodically, say once a minute, sequentially in opposite directions.

Figure 8:
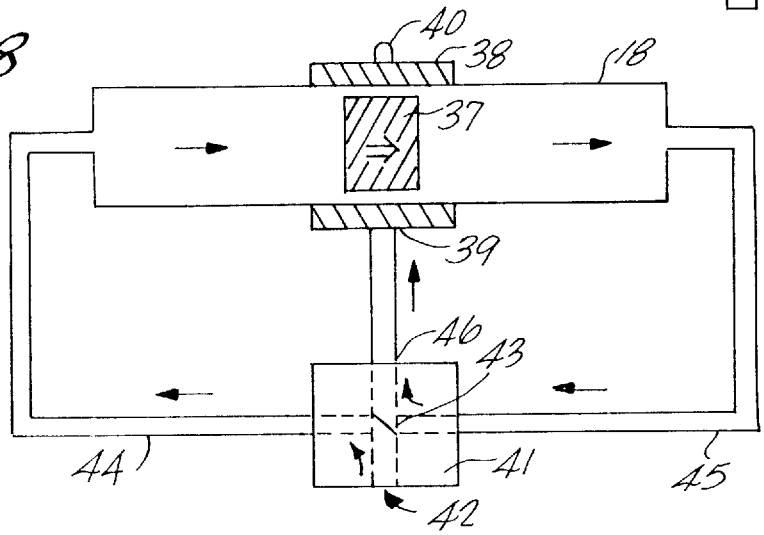
FIG. 8 shows a magnetically operated air cylinder.

FIG. 8 shows an example of how piston 37 may be connected to a moveable air jet. In this embodiment, piston 37 is a magnetic slug mounted within cylinder 18. A metal collar 38 is mounted on the outside of the cylinder and includes an inlet 39 and an outlet 40 for air or other gas. Outlet 40 is a nozzle for producing the air jet. Collar 38 is arranged to slide easily over the surface of cylinder 18. A valve means 41 is provided which enables exhaust gas from the cylinder to be provided to the nozzle for use as the gas jet. One example is shown schematically but other examples will be apparent. Air from an input 42 is directed by an inclined valve plate 43 to an air-line 44 to the left side of cylinder 18. It passes through the cylinder, displacing slug 37 and thereby collar 38 and nozzle 40, to a line 45. The valve plate 43 deflects the exhaust air to an outlet 46 connected to inlet 39 on the collar, from where it is applied to nozzle 40. Upon reversal of the flow of air through the cylinder, the valve plate can be angularly displaced to direct air input at 42 through line 45, out through line 44 then through outlet 46.

Exhaust gas may also be used as the air-jet when other types of cylinder than magnetic ones are used.

I claim:

1. Apparatus for sorting material into desired and undesired pieces or portions according to their optical characteristics, comprising:

a background;

a viewing means for viewing the material against the background;

means for discriminating optical characteristics of the material relative to the background and for sorting the material accordingly; and means for removing debris from the background, wherein said debris-removing means comprises means for providing a jet of fluid movable relative to the background, and directed towards the background, so as to clean the background, and wherein the debris-removing means is located to remain out of the optical path between the viewing means and the background, such that the sorting can continue substantially uninterrupted whilst debris is removed.

2. Apparatus as claimed in claim 1 wherein the debris-removing means is moved periodically to direct the jet of fluid from one side of the background to the other.

3. Apparatus as claimed in claim 1 wherein the fluid is air.

4. Apparatus as claimed in claim 3 wherein the air jet is provided by an air-operated cylinder having a piston which is displaced back and forth by the action of air flow in the cylinder, and an air nozzle being associated with said piston to move therewith.

5. Apparatus as claimed in claim 4 wherein exhaust gas from said cylinder is applied to said nozzle for use as the air jet.

6. Apparatus as claimed in claim 5 wherein said piston is magnetically linked to a body bearing said nozzle, so that movements of the piston cause movements of the body.

7. Apparatus as claimed in claim 1 wherein the fluid is water.

8. Apparatus as claimed in claim 1, further comprising stationary water supply means for providing a continuous flow of water over the background, and wherein the movable jet of fluid is periodically moved over the flowed water.

9. Apparatus as claimed in claim 1 wherein the background comprises a cover mounted over one or more lamps.

10. Apparatus as claimed in claim 9 wherein the cover is a cylindrical sleeve having an axis about which it is rotatable, and wherein said one or more lamps are mounted in the cylindrical sleeve.

11. In an apparatus for sorting material into desired and undesired pieces or portions according to their optical characteristics, comprising a background, a viewing means for viewing for the material against the background, sorting means, and a movable nozzle; a method for removing debris from the background comprising the steps of:

providing a jet of fluid from the movable nozzle which remains out of an optical path between the viewing means and the background, such that debris removal occurs whilst sorting is taking place;

moving the jet of fluid relative to and across the background; and directing the jet of fluid towards the background, so as to remove debris and thereby clean the background.

12. A method as claimed in claim 11 wherein the fluid is water.

13. A method as claimed in claim 11 wherein the fluid is air.

14. A method as claimed in claim 11 further comprising the step of providing the jet periodically.

15. A method as claimed in claim 11 further comprising the step of continuously providing a flow of water over the background, and periodically providing a jet of air or water which is moved relative to and across the background and flowed water.

16. A method as claimed in claim 11, wherein the apparatus further comprises an air cylinder, and further comprising the steps of moving the jet across the background with the air cylinder, and feeding back exhaust gas from the air cylinder for use as the jet itself.

17. A method as claimed in claim 16 wherein the air cylinder is a magnetic type cylinder.

18. A method as claimed in claim 11 wherein the background comprises a cover or sleeve over one or more lamps, and further comprising the step of rotating said cover or sleeve.

19. A method as claimed in claim 11, further comprising the step of moving the jet periodically over the background.

20. Sorting apparatus comprising:

a background;

a viewing means for viewing the material against the background;

means for sorting material into desired and undesired pieces or portions according to their optical characteristics; and means for removing debris from the background, wherein said debris-removing means comprises means for providing a jet of fluid movable relative to the background, and directed towards the background, so as to clean the background, and wherein the debris-removing means is located to remain out of the optical path between the viewing means and the background, such that the sorting can continue substantially uninterrupted whilst debris is removed.

21. Sorting apparatus comprising:

a background;

a viewing means for viewing the material against the background;

means for optically discriminating the material relative to the background to facilitate the sorting of the material according to its optical characteristics; and means for removing debris from the background, wherein said debris-removing means comprises means for providing a jet of fluid movable relative to the background, and directed towards the background, so as to clean the background, and wherein the debris-removing means is located to remain out of the optical path between the viewing means and the background, such that the sorting can continue substantially uninterrupted whilst debris is removed.

* * * * *